US006708611B2

(12) United States Patent
Fujimoto

(10) Patent No.: US 6,708,611 B2
(45) Date of Patent: Mar. 23, 2004

(54) PRINTING CONTROL SYSTEM

(75) Inventor: Masatoshi Fujimoto, Inashiki-gun (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 10/236,927

(22) Filed: Sep. 9, 2002

(65) Prior Publication Data

US 2003/0048324 A1 Mar. 13, 2003

(30) Foreign Application Priority Data

Sep. 11, 2001 (JP) ..... 2001-274586

(51) Int. Cl.[7] ..... B41L 13/00; B41L 21/00

(52) U.S. Cl. ..... 101/118; 101/484; 101/116; 700/222; 347/16; 400/582

(58) Field of Search ..... 101/114, 116, 101/118, 129, 484; 700/222, 3, 4, 28; 399/16, 82; 347/5, 6, 104; 400/582, 605

(56) References Cited

U.S. PATENT DOCUMENTS 5,979,311 A * 11/1999 Kakurai et al. ..... 101/118
6,237,485 B1 * 5/2001 Fukai ..... 101/118

* cited by examiner

*Primary Examiner*—Leslie J. Evanisko
(74) *Attorney, Agent, or Firm*—Nixon Peabody LLP; Donald R. Studebaker

(57) ABSTRACT

A printing control system for a printer includes the same number of one-page tasks as the number of printing papers which can be simultaneously present on the printing path of the printer at the maximum and a main control task which starts one of the one-page control means which are free each time a printing paper is supplied. Each of the one-page control tasks controls printing action on the corresponding printing paper from the step of supplying the corresponding printing paper to the step of discharging the corresponding printing paper and is made free when the printing action on the corresponding printing paper is successfully finished or when an error is detected during the printing action on the corresponding printing paper.

3 Claims, 4 Drawing Sheets

Figure 1:
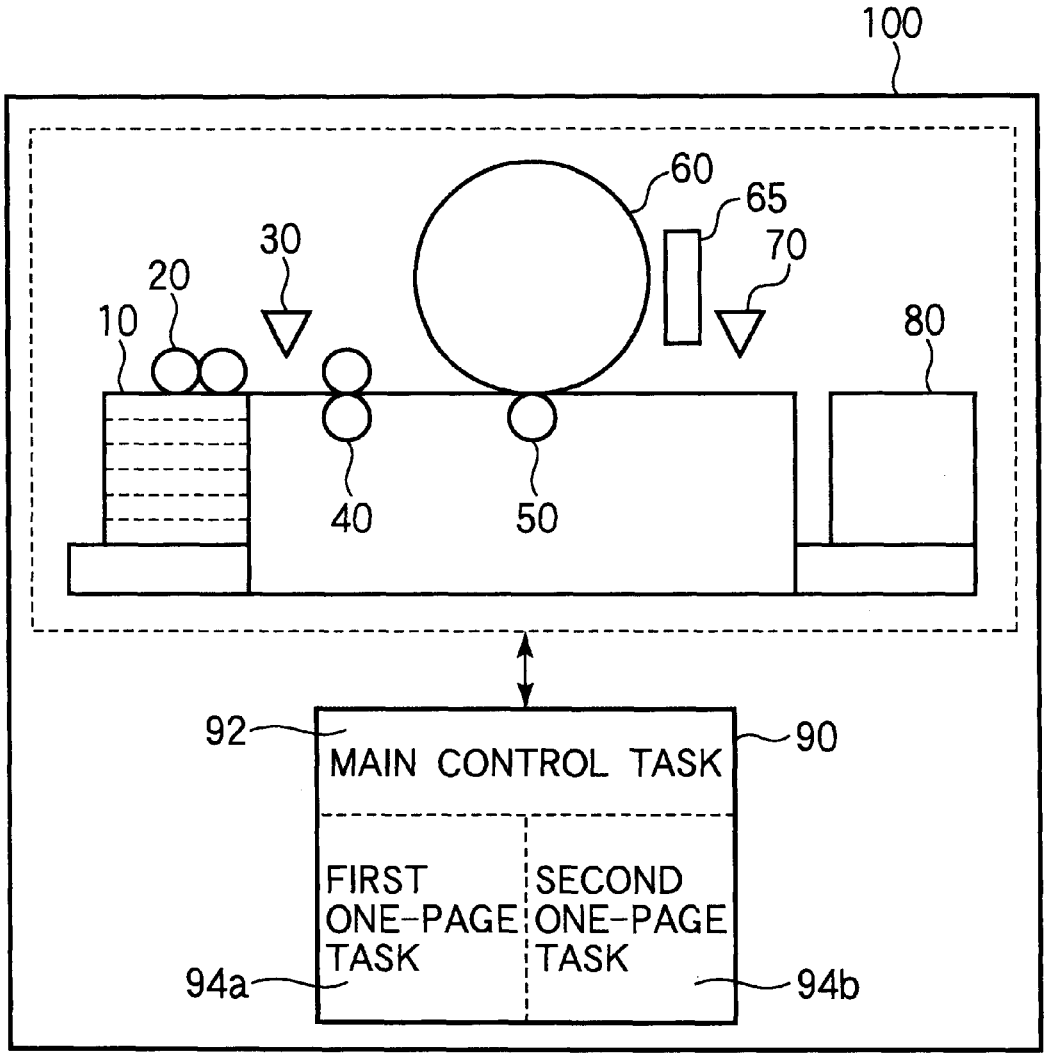

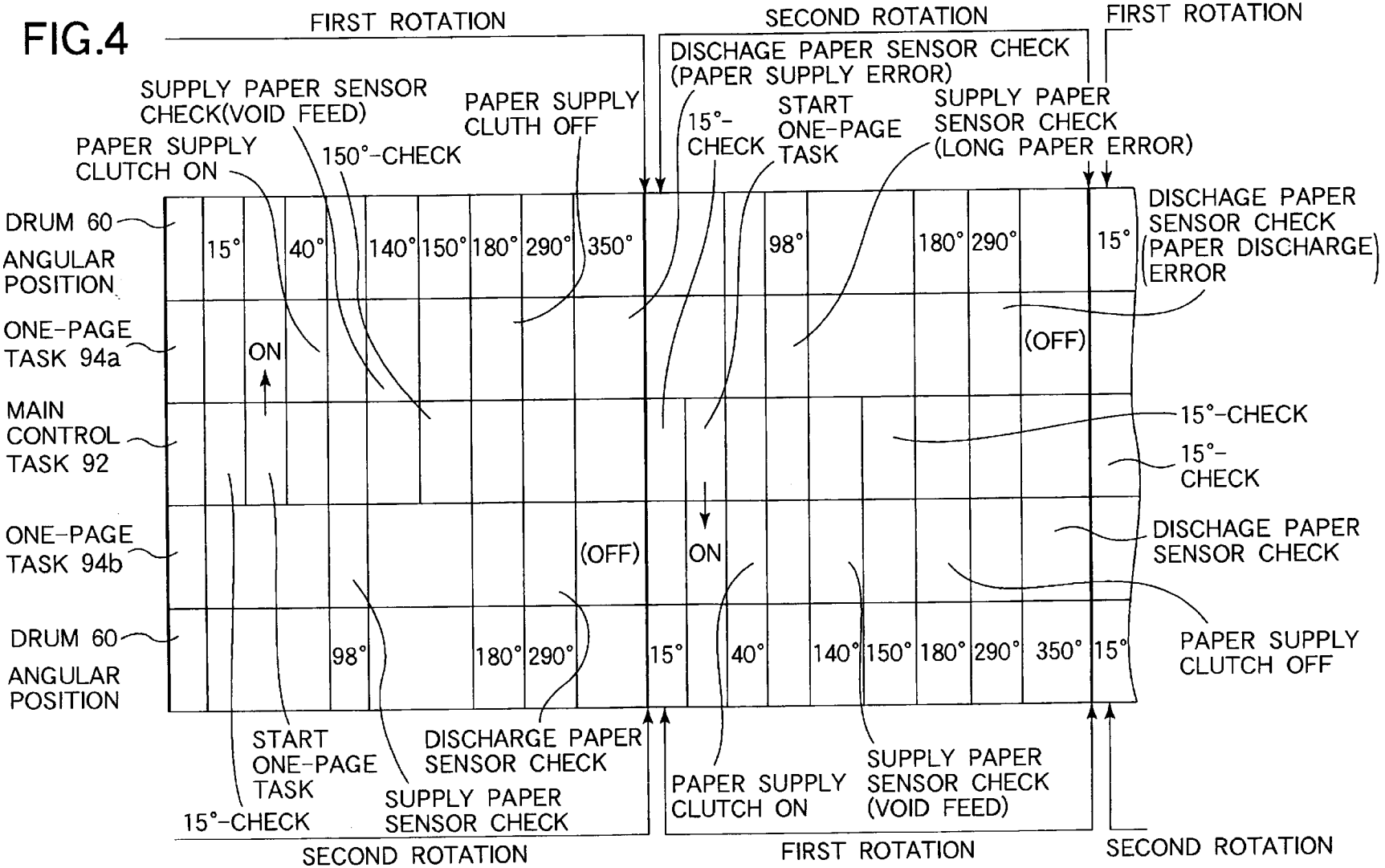
FIG.4
DRUM 60 ANGULAR POSITION
ONE-PAGE TASK 94a
MAIN CONTROL TASK 92
ONE-PAGE TASK 94b
DRUM 60 ANGULAR POSITION
PAPER SUPPLY CLUTCH ON
SUPPLY PAPER SENSOR CHECK(VOID FEED)
15°-CHECK
PAPER SUPPLY CLUTH OFF
ON
START ONE-PAGE TASK
15°-CHECK
SUPPLY PAPER SENSOR CHECK
DISCHARGE PAPER SENSOR CHECK
(OFF)
FIRST ROTATION
SECOND ROTATION
DISCHAGE PAPER SENSOR CHECK (PAPER SUPPLY ERROR)
15°-CHECK
START ONE-PAGE TASK
SUPPLY PAPER SENSOR CHECK (LONG PAPER ERROR)
DISCHAGE PAPER SENSOR CHECK (PAPER DISCHARGE ERROR)
15°-CHECK
15°-CHECK
DISCHAGE PAPER SENSOR CHECK
PAPER SUPPLY CLUTCH OFF
PAPER SUPPLY CLUTCH ON
SUPPLY PAPER SENSOR CHECK (VOID FEED)
FIRST ROTATION
SECOND ROTATION
15° 40° 98° 150° 140° 180° 290° 350°
15° 40° 98° 150° 140° 180° 290° 350° 15°

PRINTING CONTROL SYSTEM

BACKGROUND OF THE INVENTION

1. Field of the Invention

This invention relates to a printing control system for a printer such as a stencil printer in which two or more printing papers can be simultaneously present on its printing path.

2. Description of the Related Art

In a printer such as a stencil printer, the printing action of the printer including supply of printing papers from a paper supply table to a printing mechanism, transfer of ink through a stencil on a printing drum in the printing mechanism and discharging printed papers from the printing drum to a paper discharge table is controlled by a printing control system provided in the printer. The printing control system executes mainly the steps of starting the paper feed mechanism, checking whether paper supply has been successfully performed, pressing the printing paper against the printing drum, checking whether paper discharge has been successfully performed, updating the total count of the numbers of prints and the like and controls these steps in sequence according to the status of sensors and/or the angular position of the printing drum.

In a single-drum stencil printer (a stencil printer having a single printing drum), one printing paper is fed to the printing drum each time the printing drum makes one rotation. Since the printing drum makes two rotations from the time each printing paper is fed from the paper supply table to the time the printing paper is discharged to the paper discharge table, two papers are simultaneously present on the printing path of the single-drum stencil printer in the steady state of printing, that is, except when a first printing paper is fed and when a last printing paper is fed. The "printing path of the printer" is a path along which the printing papers are fed from the paper supply table to the paper discharge table. In the case of a single-drum stencil printer, the "printing path" is a path between the paper feed table and the paper discharge table including the paper feed mechanism, the pressing mechanism, the printing drum, the paper discharge mechanism and the like.

In printers having two or more printing drums, more printing papers are simultaneously present on the printing path.

The printing control system must detect the paper jam for all the printing papers present on the printing path. From the viewpoint of the flow of the printing steps, the step of starting the paper feed mechanism for feeding the following printing paper and the step of checking whether supply of the following printing paper has been successfully performed should be done before the step of checking whether the preceding printing paper has been successfully discharged. Only this requisition complicates the processing by the printing control system. Requisition involved by the fact that since only one printing paper is present on the printing path in the period when a first printing paper is fed from the paper feed table and the period when a last printing paper is discharged to the paper discharge table, control processing different from that for the steady state of printing must be incorporated in order to deal with the periods and the fact that special situations, e.g., a situation where void feed (no printing paper is fed) is made, a situation where printing is to be made on longer printing papers, and the like, must be dealt with, further complicates the processing by the printing control system in order to realize proper paper jam detection.

SUMMARY OF THE INVENTION

In view of the foregoing observations and description, the primary object of the present invention is to provide a printing control system which can make the printing control easily and precisely in a printer where two or more printing papers can be simultaneously present on its printing path.

In accordance with the present invention, there is provided a printing control system for a printer comprising the same number of one-page control means as the number of printing papers which can be simultaneously present on the printing path of the printer at the maximum and a main control means which starts one of the one-page control means which are free each time a printing paper is supplied, wherein each of said one-page control means controls printing action on the corresponding printing paper from the step of supplying the corresponding printing paper to the step of discharging the corresponding printing paper and is made free when the printing action on the corresponding printing paper is successfully finished or when an error is detected during the printing action on the corresponding printing paper.

That is, in the printing control system of the present invention, unlike the convention printing control system where printing actions on all the printing papers present on the printing path are controlled in sequence by the printing control system, the printing action on each of the printing papers is controlled by one one-page control means and each one-page control means is started by the main control means each time one printing paper is supplied. Accordingly, control of the printing action is facilitated and accuracy in paper jam detection can be improved.

When said printing action is stencil printing, the one-page control means executes the steps of starting the paper feed mechanism, checking whether paper supply has been successfully performed, pressing the printing paper against the printing drum, checking whether paper discharge has been successfully performed, and the like.

It is preferred that the one-page control means provides a warning when it detects an error during the printing action on the corresponding printing paper.

The one-page control means may provide a warning, for instance, by displaying a message "paper jam" on a screen of a control panel of the printer or by outputting an error detection signal to the main control means to cause the main control means to display an error massage on a screen or to interrupt the printing.

In the printing control system of the present invention, since control of the printing action is distributed among the one-page control means and the main control means so that the main control means only has to check the timing of paper supply and check the signal from each one-page control means while each of the one-page control means only has to control printing action on a single printing paper, control of the printing action is facilitated in total and a situation where void feed is made, and a situation where printing is to be made on longer printing papers can be easily dealt with.

When the one-page control means is arranged to provide a warning when it detects an error during the printing action on the corresponding printing paper, the operator can be informed of an error earlier and can deal with the error more rapidly.

BRIEF DSCRIPTION OF THE DRAWINGS

Figure 2:
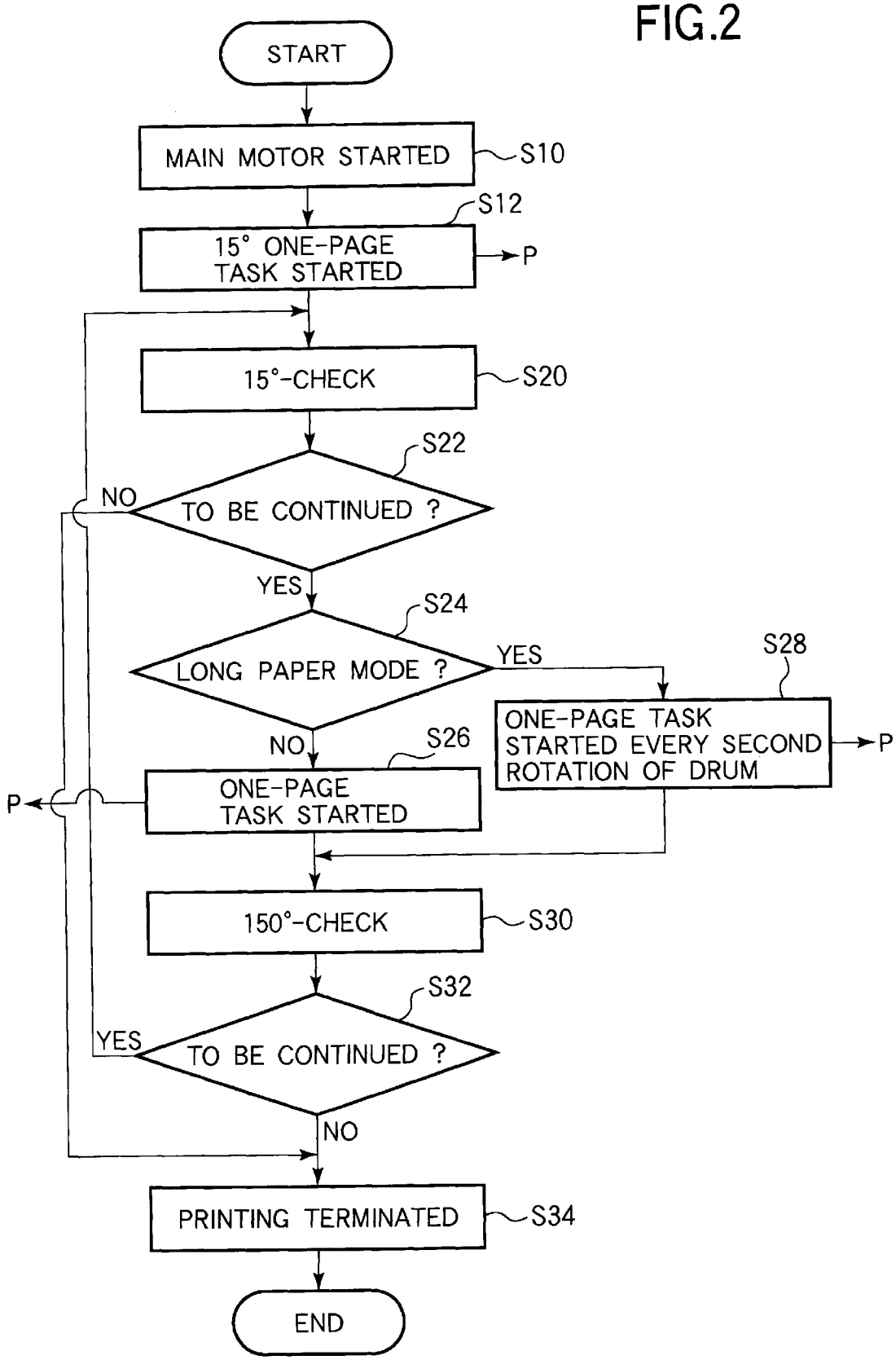
Figure 3:
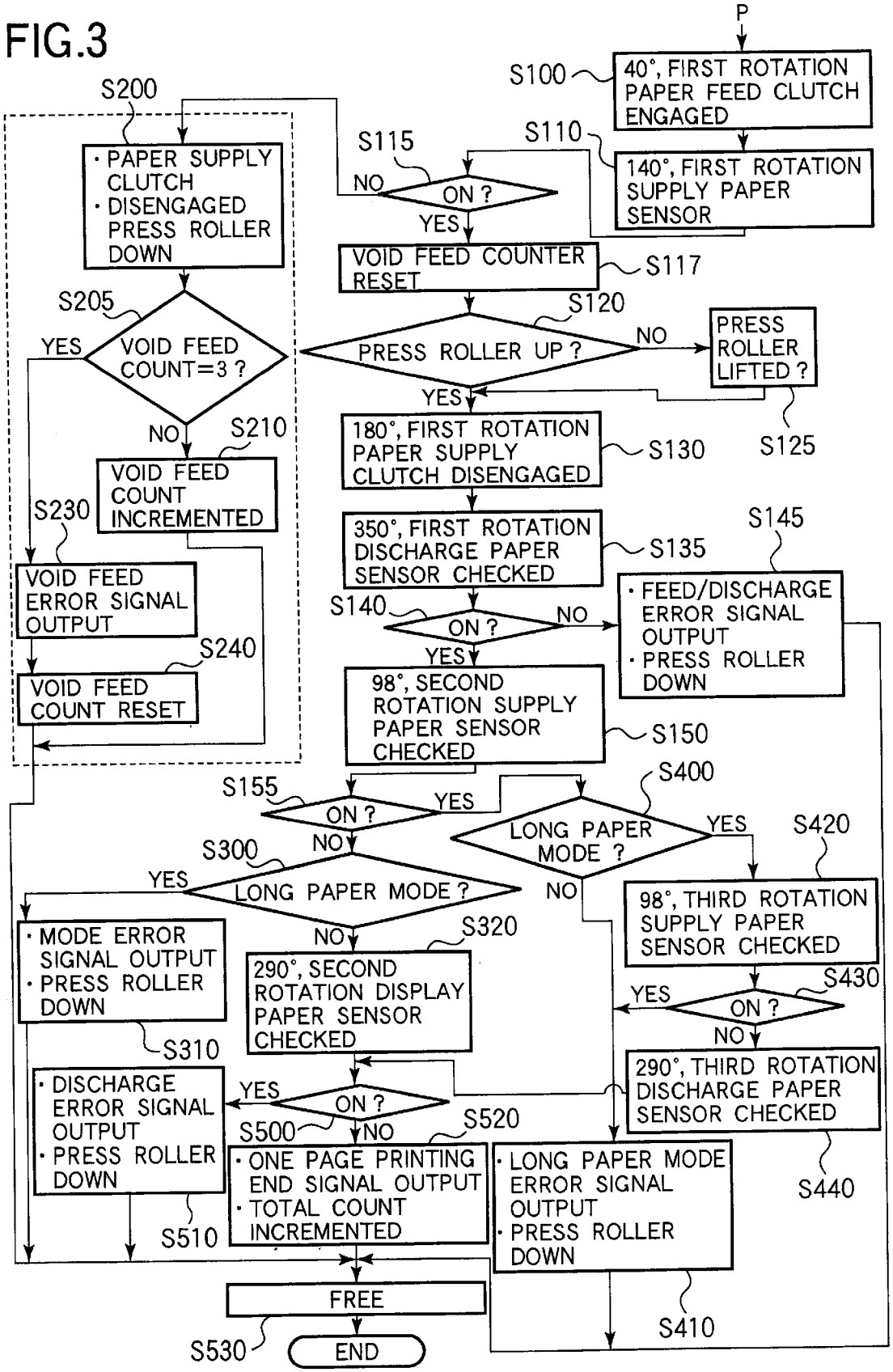

FIG. 1 is a schematic view showing a stencil printer in accordance with an embodiment of the present invention, FIG. 2 is a flow chart for illustrating the main control task of the stencil printer shown in FIG. 1, FIG. 3 is a flow chart for illustrating the one-page control task of the stencil printer shown in FIG. 1, and FIG. 4 is a timing chart for illustrating the timing of the one-page control task and the main control task of the stencil printer shown in FIG. 1.

DESCRIPTION OF THE PREFERRED EMBODIMENT

In FIG. 1, a single-drum stencil printer 100 in accordance with an embodiment of the present invention comprises a paper supply table 10 on which a stack of printing papers is stocked, a pair of paper supply rollers 20, a supply paper sensor 30 for monitoring paper supply, a pair of guide rollers 40 which lead the supplied paper to a printing drum 60, a press roller 50 which presses the supplied paper against the printing drum 60 into close contact therewith, the printing drum 60 which is provided with an ink supply mechanism (not shown) inside thereof and is rotated by a main motor (not shown) to transfer ink through a stencil (which has been made by a stencil making means not shown and has been wound around the printing drum 60) to the printing paper brought into close contact with the printing drum 60 by the press roller 50, a discharge paper sensor 70 for monitoring paper discharge, a paper discharge table 80 on which discharged printed papers are stacked, a printing control section 90 which controls printing action from paper supply to paper discharge, and a drum position sensor 65 which detects the angle of rotation of the printing drum 60 by which the printing drum 60 is rotated from a reference position and outputs the position of the printing drum 60 to the printing control section 90. The paper supply rollers 20 are connected to the main motor described above by way of a paper supply clutch (not shown) and the printing control section 90 is provided with a main control task 92 and first and second one-page tasks 94*a* and 94*b*.

In the printing control section 90 of the single-drum stencil printer 100 of this embodiment, the main control task 92 is a task for controlling the general flow of the printing action and repeats, the same number of times as the designated number of prints, starting the one-page tasks (94*a* or 94*b*), and checking a printing termination signal or an error signal from the one-page task. The first and second one-page tasks 94*a* and 94*b* are alternately started by the main control task 92, and make a check on void feed errors, a check on paper supply errors, a check on longer paper supply errors and a check on paper discharge errors in sequence and controls the paper supply and pressing the printing paper against the printing drum 60 on the basis of the result of these checks. When printing on the corresponding printing paper has been done successfully without an error, the first and second one-page tasks 94*a* and 94*b* send a one-page printing end signal representing that the corresponding printing paper has been successfully printed to the main control task 92 to update the total count of the numbers of prints and end their tasks, that is, are made free. To the contrast, when the first and second one-page tasks 94*a* and 94*b* detect an error during the printing action, they send an error signal to the main control task 92 and end their tasks. The main control task 92 generates a warning sound, displays an error message on a liquid crystal panel of the stencil printer 100 and stops the printer 100 as soon as it receives an error signal from one of the active one-page tasks 94*a* and 94*b*.

The operation of the printing control section 90 of the stencil printer 100 of this embodiment will be described in more detail with reference to the flow charts shown in FIGS. 2 and 3, hereinbelow.

FIG. 2 is a flow chart for illustrating the operation which the overall printing control section 90 executes after the number of prints has been set, a printing mode (e.g., the regular printing mode or the long paper mode) has been selected and the printing start command has been output (e.g., the start button of the stencil printer 100 has been pushed). FIG. 3 is a flow chart for illustrating the operation which each of the first and second one-page tasks 94*a* and 94*b* executes after the number of prints has been set, a printing mode (e.g., the regular printing mode or the long paper mode) has been selected and the printing start command has been output (e.g., the start button of the stencil printer 100 has been pushed). As shown in FIG. 2, the main control task 92 first starts the main motor upon receipt of the printing start command. (step S10) The angular position of the printing drum 60 is detected by the drum position sensor 65 and a signal representing the angular position of the printing drum 60 is constantly input into the main control task 92 and the first and second one-page tasks 94*a* and 94*b*, and the main control task 92 starts the first one-page task 94*a* when the printing drum 60 is rotated by 15°. (step S12) When started, the one-page task 94*a* initiates control P by one-page task, and at the next cycle, the main control task 92 executes 15°-check to check whether an error signal is output from the first or second one-page task 94*a* or 94*b* which is active or whether a forced termination signal, which is output, for instance, when a stop key is depressed, is output. (step S20) When an error signal or a forced termination signal is output or when the count of the number of prints reaches the designated number of prints, the main control task 92 terminates the printing action (step S22→step S34) and otherwise continues the printing action (step S22→step S24). When it is determined in step S22 that the printing action is to be continued, that is, when no error signal or forced termination signal is output or when the count of the number of prints does not reach the designated number of prints yet, the main control task 92 first determines whether the printing mode has been set to the long paper mode. (step S24) In this particular embodiment, the long paper mode is a mode in which printing is done on a printing paper longer than regular printing papers and in the long paper mode, the printing papers are fed every second rotation of the printing drum 60. When it is determined in step S24 that the printing mode has not been set to the long paper mode, the main control task 92 immediately starts a free one-page task (in the case of a second printing paper, the second one-page task 94*b*). (step S26) The started one-page task initiates the one-page task control P. When the printing drum 60 is rotated to 150°, the main control task 92 executes 150°-check to check whether an error signal is output from the first or second one-page task 94*a* or 94*b* which is active, whether a forced termination signal is output or whether the count of the number of prints reaches the designated number of prints. (step S30) When an error signal or a forced termination signal is output or when the count of the number of prints reaches the designated number of prints, the main control task 92 terminates the printing action (step S32→step S34) and otherwise, that is, when no error signal or forced termination signal is output or when the count of the number of prints does not reach the designated number of prints yet, the main control task 92 continues the printing action and repeats the steps from step S20.

When it is determined in step S24 that the printing mode has been set to the long paper mode, the main control task 92 does not immediately start but starts a free one-page task every second rotation of the printing drum 60 (step S28) and when the printing drum 60 is rotated to 150° in that rotation, the main control task 92 executes 150°-check to check whether an error signal is output from the first or second one-page task 94*a* or 94*b* which is active, whether a forced termination signal is output or whether the count of the number of prints reaches the designated number of prints. (step S30) When an error signal or a forced termination signal is output or when the count of the number of prints reaches the designated number of prints, the main control task 92 terminates the printing action (step S32→step S34) and otherwise, that is, when no error signal or forced termination signal is output or when the count of the number of prints does not reach the designated number of prints yet, the main control task 92 continues the printing action and repeats the steps from step S20.

Thus, in the case of the regular printing mode, the main control task 92 makes the 15°-check each time the printing drum 60 is rotated to 15° in each rotation, when the result of the 15°-check indicates that the printing action is to be continued, the main control task 92 starts a free one-page task to cause the one-page task to control printing action on the corresponding printing paper, then the main control task 92 makes the 150°-check when the printing drum 60 is rotated to 150° in that rotation, and the main control task 92 repeats the control described above when the result of the 150°-check indicates that the printing action is to be continued. To the contrast, in the case of the long paper mode printing, the operation of the main control task 92 is basically the same except that the steps from the 15°-check to the 150°-check are executed every second rotation of the printing drum 60.

The main control task 92 generates a warning sound, displays an error message on a liquid crystal panel of the stencil printer 100 and stops the printer 100 as soon as it receives an error signal from one of the active one-page tasks 94*a* and 94*b*.

FIG. 3 is a flow chart showing in detail the operation of the one-page task (94*a* or 94*b*) of the stencil printer 100. As described above, the one-page task initiates the one-page task control P when started by the main control task 92. The first and second one-page tasks 94*a* and 94*b* are alternately started. The started one-page task engages the paper feed clutch to initiate paper supply at an angular position of 60° of the printing drum 60. (step S100) Then the one-page task checks whether the supply paper sensor 30 is on, that is, whether the supply paper sensor 30 has detected a printing paper, at an angular position of 140° of the printing drum 60. (steps S110 and S115) When it is determined in step S115 that the supply paper sensor 30 is off (i.e., no printing paper has passed by the supply paper sensor), the one-page sensor executes void feed control (steps S200 to S240) to be described later. To the contrast, when it is determined in step S115 that the supply paper sensor 30 is on, that is, a printing paper has been successfully fed, the one-page sensor 30 resets a void feed counter (step S117), and determines whether the press roller 50 has been lifted (up) to be pressed against the printing drum 60 (step S120). The one-page task lifts the press roller as required (if the press roller 50 has not been lifted) (step S125), and the ink is transferred to the printing paper through the stencil on the printing drum 60 (the printing paper is printed). When the printing drum 60 is subsequently rotated to 180°, the one-page task disengages the paper feed clutch. (step S130) As the printing progresses and the printing drum 60 is rotated to 350°, the one-page task checks whether the discharge paper sensor 70 is on, that is, whether the discharge paper sensor 70 has detected a printing paper. (steps S135 and S140) When it is determined in step S140 that the discharge paper sensor 70 is off, the one-page sensor determines that the printing paper has not been successfully fed to the printing drum 60 or has not been successfully discharged from the printing drum 60, and outputs a paper feed error/paper discharge error signal to the main control task 92 and causes the press roller 50 to be moved downward away from the printing drum 60. (step S145) Then the one-page sensor ends its own task and becomes free. (step S530) To the contrast, when it is determined in step S140 that the discharge paper sensor 70 is on, the one-page sensor determines that the printing paper has been successfully fed to the printing drum 60 and has been successfully discharged from the printing drum 60 and continues controlling printing on the corresponding printing paper. Taking the rotation of the printing drum 60 at which the one-page task is started as a first rotation of the printing drum 60, the one-page task checks the supply paper sensor 30 again when the printing drum 60 is rotated to 98° in its second rotation (that is, the time by which the trailing end of the printing paper should have passed by the supply paper sensor 30 if the printing paper which is being controlled by the one-page task is of the regular length and has been successively fed). (steps S150 and S155) When it is determined in step S155 that the supply paper sensor 30 is off, the one-page task determines whether the printing mode is set to the long paper mode. (step S300) When it is determined in step S300 that the printing mode has been set to the long paper mode, that is the case where a printing paper of the regular length has been fed though the printing mode has been set to the long paper mode, the one-page sensor sends a mode error signal to the main task 92, causes the press roller 50 to be moved downward away from the printing drum 60 and ends its own task to become free. (steps S310 and S530) To the contrast, when it is determined in step S300 that the printing mode has been set to the regular printing mode, the one-page sensor continues controlling printing on the corresponding printing paper. When the printing drum 60 is rotated to 290° in its second rotation (that is, the time by which the trailing end of the printing paper should have passed by the discharge paper sensor 70 if the printing paper is successfully discharged from the printing drum 60), the one-page task checks the discharge paper sensor 70 again. (steps S320 and S500) When it is determined in step S500 that the discharge paper sensor 70 is on, the one-page task determines that a discharge error has occurred and sends a discharge error signal to the main control task 92, causes the press roller 50 to be moved downward away from the printing drum 60 and ends its own task to become free. (steps S510 and S530) To the contrast, when it is determined in step S500 that the discharge paper sensor 70 is off, the one-page task sends one page printing end signal to the main control task 92 to increment the total count of the numbers of prints by one (step S520), and ends it task (step S530), that is, becomes free.

When it is determined in step S155 that the supply paper sensor 30 is on, the one-page task determines whether the printing mode has been set to the long paper mode. (step S400) When it is determined in step S400 that the printing mode has not been set to the long paper mode, the one-page task determines that a long paper mode error has occurred and sends a long paper mode error signal to the main control task 92, causes the press roller 50 to be moved downward away from the printing drum 60 and ends its own task to become free. (steps S410 and S530) To the contrast, when it is determined in step S400 that the printing mode has been set to the long paper mode, the one-page task determines that the printing action has been successfully done on the corresponding printing paper and continues controlling printing on the corresponding printing paper. Then, the one-page task checks the supply paper sensor 30 again (third check) when the printing drum 60 is rotated to 98° in its third rotation. (steps S420 and S430) When it is determined in step S430 that the supply paper sensor 30 is on, which is the case, for instance, when a printing paper longer than a predetermined length is used, the one-page task determines that a long paper mode error has occurred and sends a long paper mode error signal to the main control task 92, causes the press roller 50 to be moved downward away from the printing drum 60 and ends its own task to become free. (steps S410 and S530) To the contrast, when it is determined in step S430 that the supply paper sensor 30 is off, the one-page sensor continues controlling printing on the corresponding printing paper and when the printing drum 60 is rotated to 290° in its third rotation (that is, the time by which the trailing end of the long printing paper should have passed by the discharge paper sensor 70 if the long printing paper is successfully discharged from the printing drum 60), the one-page task checks the discharge paper sensor 70 again. (steps S440 and S500) When it is determined in step S500 that the discharge paper sensor 70 is on, the one-page task determines that a discharge error has occurred and sends a discharge error signal to the main control task 92, causes the press roller 50 to be moved downward away from the printing drum 60 and ends its own task to become free. (steps S510 and S530) To the contrast, when it is determined in step S500 that the discharge paper sensor 70 is off, the one-page task sends one page printing end signal to the main control task 92 to increment the total count of the numbers of prints by one (step S520), and ends it task (step S530), that is, becomes free.

Though one-page control on the regular printing mode and the long paper mode have been described above, the one-page control on the void feed control will be described in detail, hereinbelow. As described above, steps S200 to S240 are for the void feed control. In this particular embodiment, that a void feed error occurs is not determined until void feed is detected in three successive rotations of the printing drum 60. That void feed occurs is detected by checking whether the supply paper sensor 30 is on at an angular position of 140° of the printing drum 60 in each rotation thereof. That is, the one-page task disengages the paper supply clutch, moves downward the press roller 50 away from the printing drum 60 and refers to a void feed count (steps S200 and S205) immediately after detecting in step S115 that the supply paper sensor 30 is off at an angular position of 140° of the printing drum 60 in its first rotation. When it is determined in step S205 that the void feed count is 2, representing that the void feed has been detected in three successive rotations of the printing drum 60 including the rotation at that time, the one-page task sends a void feed error signal to the main control task 92 to reset the void feed count (steps S230 and S240), and ends its own task to become free (step S530). When it is determined in step S205 that the void feed count is 0 or 1, the one-page task does not send a void feed error signal to the main control task 92 and increments the void feed count (step S220). Thereafter the one-page task ends its own task to become free (step S530).

Though operation of the main control task 92, and the first and second one-page tasks 94*a* and 94*b* of the stencil printer 100 of this embodiment has been described in detail, operation of the control section 90 will be described in more detail with reference to the timing chart shown in FIG. 4.

FIG. 4 is a timing chart showing the operation of each task of the printing control section 90 from the time immediately before the first one-page task 94*a* is started to the time the first one-page task 94*a* becomes free during the regular mode printing assuming that the printing action is successfully done without an error, a forced termination or the like.

As shown in FIG. 4, at an angular position of 150 of the printing drum 60, the main control task 92 executes the 15°-check and starts the first one-page take 94*a* immediately thereafter. The started one-page task 94*a* causes the paper supply clutch to engage at an angular position of 40° of the printing drum 60. When the printing drum 90 is rotated to 98° (in a first rotation of the printing drum 60 for the first one-page task 94*a* and in a second rotation of the printing drum 60 for the second one-page task 94*b*), the second one-page task 94*b* checks the supply paper sensor 30. When the printing drum 90 is rotated to 140°, the first one-page task 94*a* checks the supply paper sensor 30 in order to detect void feed. At an angular position of 150° of the printing drum 60, the main control task 92 executes the 150°-check. As the printing drum 60 is further rotated to 180°, the first one-page task 94*a* causes the paper supply clutch to disengage. As the printing drum 60 is further rotated to 290°, the second one-page task 94*b* checks the discharge paper sensor 70, and when there is detected no error, the second one-page task 94*b* increments the total count of the numbers of prints by one and ends it task, that is, becomes free. When the printing drum 60 is rotated to 350° the first one-page task 94*a* checks the discharge paper sensor 70 to detect a paper supply error. Thereafter the printing drum 60 further makes a rotation which is a second rotation for the first one-page task 94*a* and a first rotation for the second one-page task 94*b*. At an angular position of 15° of the printing drum 60 in its second rotation for the second one-page task 94*b*, the main control task 92 executes the 15°-check and starts the second one-page take 94*b* which is free at that time. The started one-page task 94*b* causes the paper supply clutch to engage and starts paper supply when the printing drum 60 is rotated to 40° in that rotation thereof. When the printing drum 90 is further rotated to 98°, the first one-page task 94*a* checks the supply paper sensor 30 to detect a long paper error. When the printing drum 90 further rotated to 290°, the first one-page task 94*a* makes a second check on the discharge paper sensor 70 in order to detect a paper discharge error and when there is detected no error, the first one-page task 94*a* increments the total count of the numbers of prints by one and ends it task, that is, becomes free. At an angular position of 140° of the printing drum 60 in that rotation, the second one-page task 94*b* checks the supply paper sensor 30 to detect a void feed, at an angular position of 150° of the printing drum 60 in that rotation, the main control task 92 makes the 150°-check and, at an angular position of 180° of the printing drum 60 in that rotation, the second one-page task 94*b* disengages the paper supply clutch.

While the first one-page task 94*a* is waiting, i.e., being free, the printing drum 60 is kept rotated, and when the printing drum 90 is rotated to 350°, the second one-page task 94*b* checks the discharge paper sensor 70 to detect a paper supply error.

As can be understood from the description above, in the printing control section 90 of the stencil printer 100 of this embodiment where a plurality of printing papers can be simultaneously present on the printing path, control of the printing action is distributed among the one-page control tasks 94*a* and 94*b* and the main control task 92 so that the main control task 92 starts one free one-page task each time a printing paper is to be fed, and each of the one-page tasks 94*a* and 94*b* controls printing action on one printing paper from the time the printing paper is supplied to the time the printing paper is discharged. Accordingly, the main control task 92 only has to check the timing of paper supply and check the signal from each one-page task and each of the one-page control means only has to control printing action on a single printing paper, whereby the one-page task can easily catch behavior of the printing paper, control of the printing action is facilitated, and a situation where void feed is made or where printing is to be made on longer printing papers can be easily dealt with.

Though, in the embodiment described above, the present invention is applied to a stencil printer, the present invention can be applied to various printers other than the stencil printer where a plurality of printing papers can be simultaneously present on the printing path thereof.

Further, in the embodiment described above, the present invention is applied to a single-drum stencil printer where only a pair of printing papers can be simultaneously present on the printing path, the present invention can be applied also to a multi color stencil printer where two or more printing drums are simultaneously provided and three or more printing papers can be simultaneously present on the printing path and can further facilitate the control.

Further, in the embodiment described above, the printing control section is arranged so that the main control task starts one of the one-page tasks and the paper supply clutch is engaged by the started one-page task at an angular position of 40° of the printing drum, the printing control section may be arranged so that the main control task starts one of the one-page tasks immediately before the printing drum is rotated to 40° while the paper supply clutch is engaged by the main control task when the printing drum is rotated to 40°. When a special paper supply unit is mounted on the printer, the printing control section may be arranged so that only paper supply is controlled by a separate task. With this arrangement, since each one-page task can be released from control of paper supply and only has to execute the void feed error check, the paper supply error check, the long paper error check, and the paper discharge error check in this order, load on each one-page task can be lightened.

What is claimed is:

1. A printing control system for a printer comprising the same number of one-page control means as the number of printing papers which can be simultaneously present on the printing path of the printer at the maximum and a main control means which starts one of the one-page control means which are free each time a printing paper is supplied, wherein each of said one-page control means controls a printing action on the corresponding printing paper from the step of supplying the corresponding printing paper to the step of discharging the corresponding printing paper and is made free when the printing action on the corresponding printing paper is successfully finished or when an error is detected during the printing action on the corresponding printing paper.

2. A printing control system as defined in claim 1 in which said printing action is stencil printing, and each of the one-page control means executes the steps of starting a paper feed mechanism, checking whether said step of paper supplying has been successfully performed, pressing the printing paper against a printing drum, and checking whether discharging has been successfully performed.

3. A printing control system as defined in claim 1 in which each of the one-page control means provides a warning when page control means detects an error during the printing action on the corresponding printing paper.

* * * * *